United States Patent [19]

Testa et al.

[11] 4,068,873

[45] Jan. 17, 1978

[54] AUTOMATICALLY CLOSING LOCK

[75] Inventors: Carmen Testa, Stamford; William J. Bouton, Jr., South Norwalk, both of Conn.

[73] Assignee: Excelsior Hardware Co., Stamford, Conn.

[21] Appl. No.: 688,773

[22] Filed: May 21, 1976

[51] Int. Cl.[2] ..... E05B 65/48; E05C 19/10

[52] U.S. Cl. ..... 292/101; 292/106; 292/228; 70/9; 70/71; 70/75

[58] Field of Search ..... 292/106, 128, 228, 101, 292/207; 70/7, 8, 10, 12, 69, 70, 71, 72, 73, 74, 75

[56] References Cited

U.S. PATENT DOCUMENTS

| | | | |
|---|---|---|---|
| 2,183,120 | 12/1939 | Levine | 70/73 |
| 2,279,757 | 4/1942 | Magnuson | 292/228 |
| 2,593,570 | 4/1952 | Kirkpatrick | 292/228 |
| 2,775,111 | 12/1950 | Savage | 70/9 |
| 3,279,226 | 10/1966 | Chance | 70/71 |
| 3,523,436 | 8/1970 | Chance | 70/75 |

FOREIGN PATENT DOCUMENTS

| | | | |
|---|---|---|---|
| 472,910 | 8/1914 | France | 70/74 |

*Primary Examiner*—Robert L. Wolfe

*Attorney, Agent, or Firm*—St. Onge, Mayers, Steward & Reens

[57] ABSTRACT

An automatically closing lock, for a container having a body and a closure mounted for movement to close the body, includes a catch assembly having a catch housing mountable with one of the container body and closure. The catch housing defines a striker surface and a catch surface adjacent the striker surface. A latch assembly, that cooperates with the catch assembly, includes a latch housing mountable on the other of the container body and closure and a latch member mounted for limited pivoted movement in the latch housing. The latch member is formed with at least one hook-like element that is guided to the catch surface and into engagement therewith by the striker surface. A spring compressed in the latch housing urges the latch member and hook-like element into firm contact with the striker surface and into engagement with the catch surface. The limited pivoted movement of the latch member permits its hook-like element to be disengaged from the catch surface and the container closure to be opened from the body with a single movement.

7 Claims, 6 Drawing Figures

AUTOMATICALLY CLOSING LOCK

BACKGROUND OF THE INVENTION

1. Field of the Invention

The present inventin relates to a lock for a container and, in particular, for a piece of luggage, which automatically closes and latches when the body of the container and its closure are closed together. Moreover, this lock can be opened to also open the container closure and body with a single motion.

Various types of containers, particularly luggage such as briefcases, overnight and larger suitcases, portfolio cases, valises as well as smaller rigid containers such as silver cases and jewelry cases, include a body and a closure or cover hinged to the body for movement to close and open it. It is desirable to latch and sometimes lock the body and closure together to prevent accidental opening and spilling of the contents. However, it is also desirable to be able to easily open the closure from the body when access to its contents is needed. The lock of the present invention does both.

2. Description of the Prior Art

Many types of luggage or other container locks and latches are known including drawbolts, claw bolts, simple catches, rotating heel locks and the like. However, most must be locked or latched by positive action of the user. That is, once the container body and closure are closed together, the lock mechanism must actively be set in a latched condition to prevent accidental container-closure opening. Similarly, use of most known locks and latches requires one positive action to unlock or unlatch the device and a second positive action to open the container.

SUMMARY OF THE INVENTION

In a preferred embodiment, to be described below in detail, the lock of the present invention is adapted for installation on a container body and closure and automatically latches whenever the container and closure are closed together. Moreover, this lock may be opened by merely applying finger pressure to one member and lifting the container closure upwardly in a single motion. When this member is released, the lock automatically reverts to condition to relatch when the container body and closure are closed together again.

The automatically closing lock of the present invention comprises a catch assembly which has a catch housing adapted to be mounted on one of the container closure and body. The catch housing defines a planar striker surface formed with at least one slot and a catch surface defined by the slot having a portion substantially perpendicular to the striker surface.

The lock also includes a latch assembly which has a latch housing adapted to be mounted on the other of the container closure and body and a latch member which is mounted for limited pivoting movement in the latch housing. The latch member has a web that is formed to overlie the striker surface when the latch and catch assemblies are closed together, and at least one hook-like element formed with this web to interfit with the slot. The hook-like element has an inclined edge formed to slidingly engage the catch housing, pivot the latch member away from it and to then align the hook-like element with the slot. The hook-like element also has an upper hooking edge shaped to latchingly engage the catch surface when the element is interfitted with he slot.

A spring urges the latch member to pivot into firm contact with striker surface and to pivot the hook-like element into interfitting engagement with the slot. Accordingly, when the closure and container body are closed together, the hook-like element inclined edge engages the catch housing to pivot the element into interfitting engagement with the catch slot. The upper hooking edge then latchingly engages the catch surface to prevent relative disengagement of the container body and closure.

In order to open the body and closure, the web of the latch member is lifted with finger pressure to disengage the element from the catch housing slot. It is preferable that the pivoted movement of this latch member be limited to less than 90° so that further upward finger pressure on its web causes the container closure to open from the container body. However, when the latch member is released, the compressed spring automatically returns it to condition for reengaging the catch assembly as described above.

Accordingly, it is an object of the present invention to provide an automatically closing lock which permits a container body and closure to be latched when they are closed together and further to be opened when the latch member is unlatched with minimal additional effort.

Other objects, aspects, and advantages of the present invention will be pointed out in, or will be understood from, the following detailed description provided below in conjunction with the accompanying drawings.

DETAILED DESCRIPTION OF THE PREFERRED EMBODIMENTS

Figure 1:
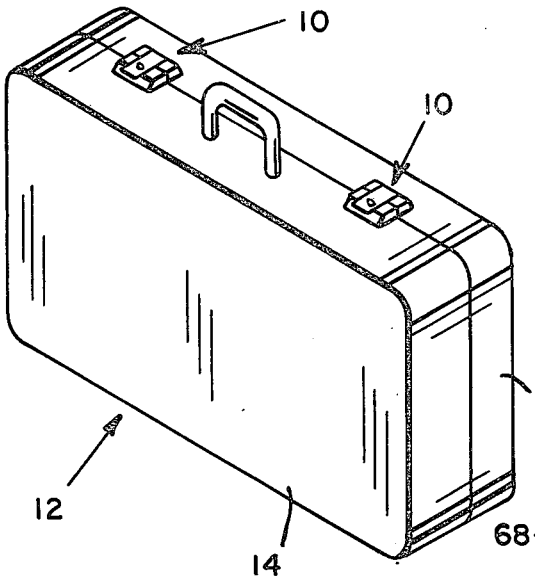
FIG. 1 is a perspective view of a container in the form of an attache case equipped with two automatically closing locks constructed in accordance with the present invention.
Figure 3:
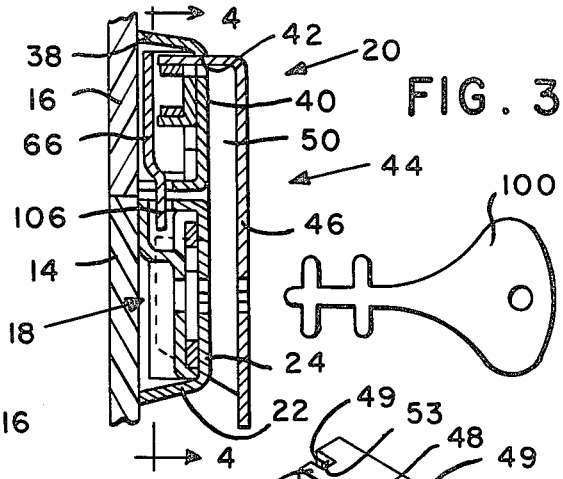
FIG. 3 is a vertical cross-sectional view of this lock taken through plane 3—3 in FIG. 4.

FIG. 1 illustrates two automatically closing locks, generally indicated at 10, installed on a container in the form of an attache case generally indicated at 12, having a body 14 and a closure 16. As described below in detail, the locks positively hold the closure and body of the case together but may be easily opened to permit access to the contents of the case.

As shown in greater detail in FIGS. 2 through 6, the automatically closing lock comprises a catch assembly, generally indicated at 18, and a cooperating latch assembly, generally indicated at 20. The components of these assemblies can be made of any suitable material such as heavy gauge stamped sheet metal. The catch assembly, which is shown in detail in FIGS. 4 and 5 includes a rectangular catch housing 22 having a closed front and an open back. A recessed striker surface 24 is formed on the front of the housing 22 and two elongated, mutually parallel slots 26 pass through the striker surface at its side margins. A catch surface 28 is defined at the top of each slot 26 which extends horizontally and is generally perpendicular to the striker surface 24.

The top wall 30 of the catch housing 22 is formed with a rectangular alignment aperture 32 the function of which is described below. Further, a locking bolt mechanism, generally indicated at 34 is mounted in the interior of the catch housing and will also be described in greater detail below.

Figure 2:
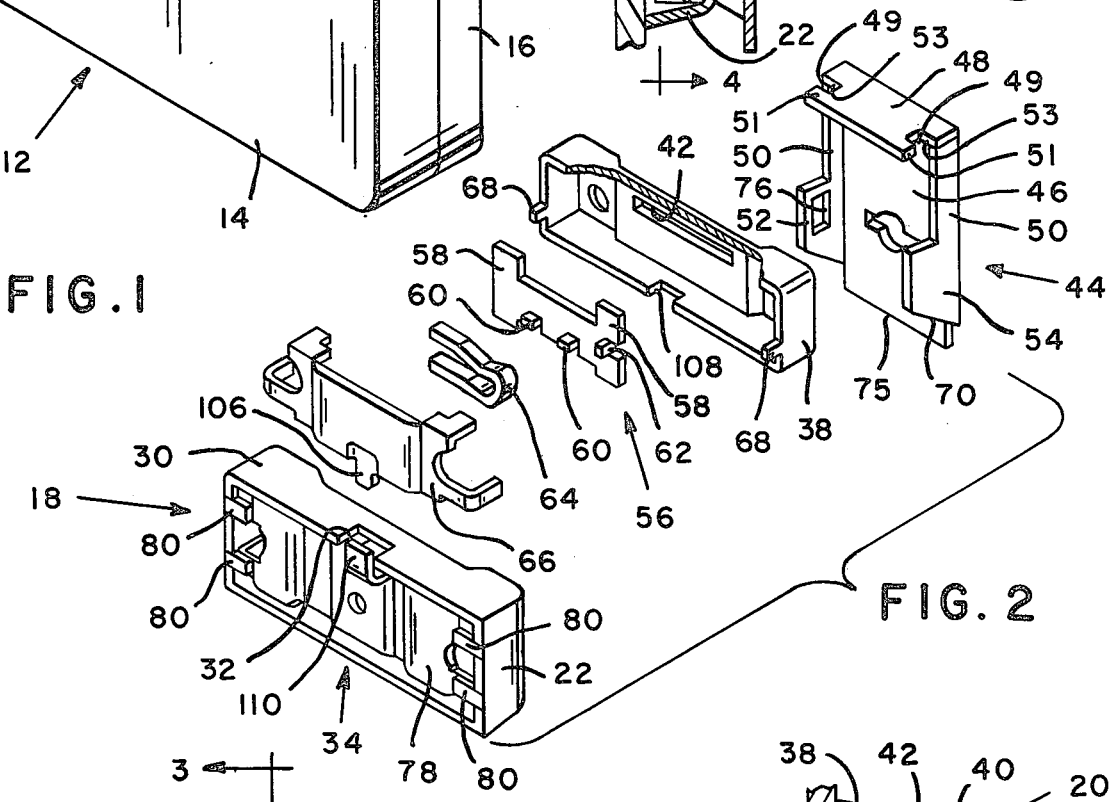
FIG. 2 is a perspective view of the automatically closing lock mechanism shown with the latch assembly in exploded form.

The latch assembly 20, shown in detail in exploded form in FIG. 2, cooperates with the catch assembly to latch the attache closure and body together. This latch assembly includes a rectangular latch housing 38 which is closed in the front and open in the back. A front surface 40 of the latch housing is recessed to correspond with the striker surface of the catch housing and an elongated slot 42 is horizontally positioned through this recessed surface near its top. A latch member, generally indicated at 44, is pivotably mounted in the latch housing 38 and includes a depending web 46 having a horizontally extending, I-shaped hangar bar 48 formed in its top. This I-shape results from two opposing notches 49 being cut in the bar to form two sidewardly directed fingers 51. Two, mutually parallel, inwardly bent ears 50 are formed at the sides of web 46 and each ear terminates in an enlarged hook-like tab 52 and 54.

The latch member is assembled with the latch housing by inserting the hanger bar 48 into the horizontal latch housing slot 42 until the base 53 of each notch 49 abuts the recessed front surface of the housing. A retainer member, generally indicated at 56, holds bar 48 in the slot. Specifically, two upwardly projecting lugs 58 formed on retainer member 56 are engaged behind the sidewardly extending fingers 51. This interfitting relationship can be seen best in FIG. 4.

Figure 6:
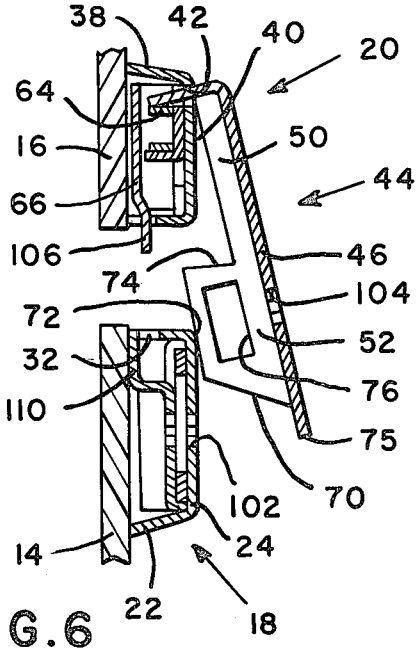
FIG. 6 is a vertical cross-sectional view similar to that shown in FIG. 3 illustrating the pivoting action of the latch member on the catch housing.
Figure 5:
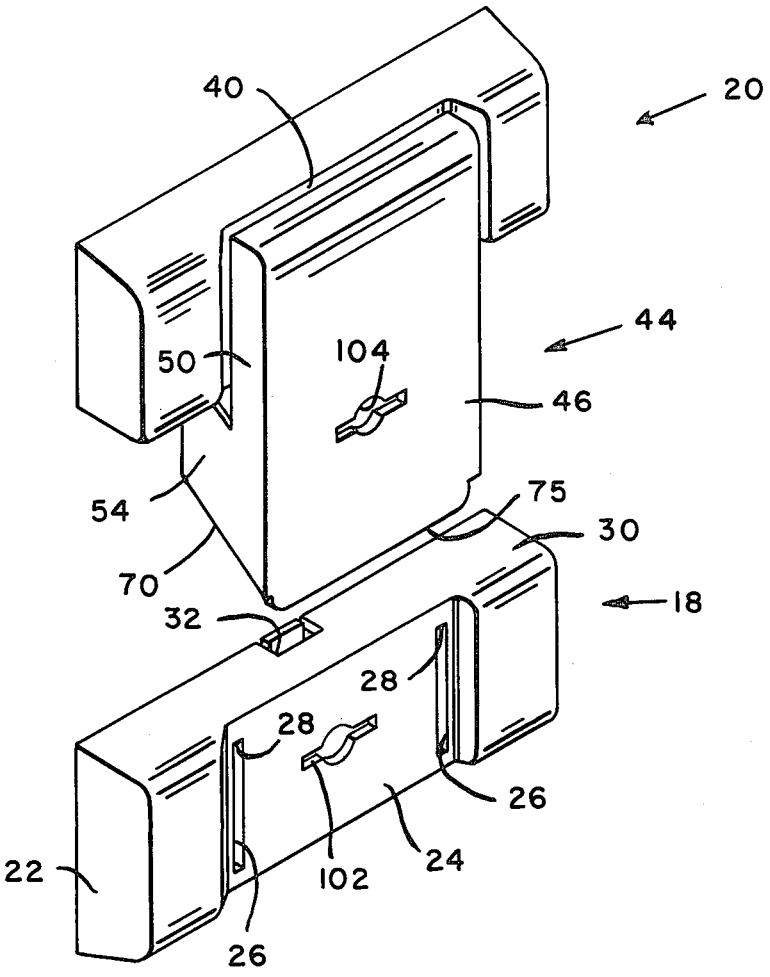
FIG. 5 is a perspective view of the front of this lock mechanism.

The retainer member is also punched with two generally horizontal, rearwardly extending ledge tabs 60 and one rearwardly directed stop 62. A flexure spring 64 is compressed between the ledges 60 and the underside projecting portion of the hanger bar 48 and is positioned by stop 62 to cause the entire latch member to rotate in a clockwise fashion when viewed from the perspective of FIGS. 3 and 6. Thus, when spring 64 expands, the latch member 44 pivots downwardly until the ears 50 abut the recessed front surface 40 of the latch housing 38. Therefore, pivoted movement of the latch member is limited in this direction. Similarly, as shown in FIG. 6, outward pivoted movement of the latch member is limited by binding of the hanger bar fingers 51 with the retaining member 56. In particular, this limited pivoted movement is less than 90° and it is preferably less than about 40°, for reasons to be described below.

The entire latch assembly is completed by a rear plate 66 which holds the spring 64 and the retainer member 56 securely in the latch housing 38 and prevents the spring 64 and retainer member 56 from becoming disengaged from the hanger bar 48 of latch member 44. This rear plate is held in position by a series of tabs 68 which are bent over the margins of the plate 66.

The catch assembly 18 and latch assembly 20 cooperate to automatically lock the closure and body of the attache case 12 together in the following manner.

Figure 4:
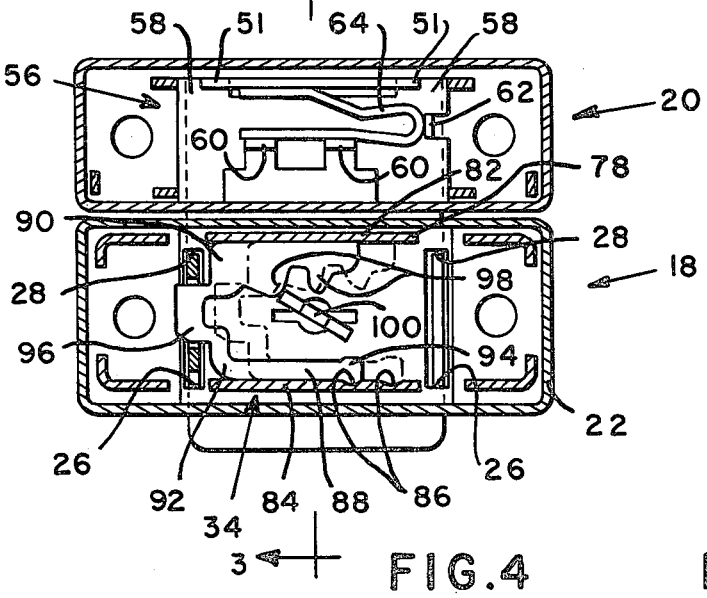
FIG. 4 is a vertical cross-sectional view taken through plane 4—4 in FIG. 3.

As shown in FIG. 4, slots 26 in the striker surface 24 of catch housing 34 are shaped to receive the hook-like tabs 52 and 54 of latch member 44. Moreover, each hook-like tab is formed with an inclined or beveled lower edge 70 which is shaped to engage the upper corner 72 of the striker surface 24 and pivot the latch member 44 in a counterclockwise direction, as shown in FIG. 6, against the spring force of spring 64. When both the catch and latch assemblies are completely engaged, the spring force causes the latch member to rotate in the clockwise direction to insert hook-like tabs 52 and 54 into slots 26. Each tab is formed with forwardly, downwardly inclined latching edge 74 which gives a hook-shaped appearance and engages the corresponding catch surfaces 28 in slots 26.. The inclined or forwardly, downwardly raked attitude of these latching edges 74 insures positive engagement with the catch surfaces, and if disengagement is attempted by opening the attache closure from its body, the resulting forces urge the latch member into tighter engagement with the catch housing.

In order to open the lock of the present invention and further open the attache closure from its body, one merely lifts the lower edge 75 of the web 46 of the latch member 44 to pivot it in a counterclockwise direction as shown in FIG. 6. Accordingly, the hook-like tabs 52 and 54 become disengaged from slot 28. Moreover, since the pivoted movement of the latch member is limited as explained above, further upward pressure by the user causes the attache closure to open from the attache body. Thus, lock and attache opening can be achieved with a single smooth and easy motion.

When the attache closure is again returned toward its closed position, the latch member automatically pivots outwardly from the catch member by action of the beveled tab edges 70 and catch housing corner 72 and striker surface 24 to guide the hook-like tabs 52 and 54 into engagement with slots 26. Locking is thus immediately and positively accomplished.

As can be seen in FIGS. 2 and 6, hook-like tab 52 is provided with a rectangular aperture 76. The lock mechanism 34, shown in detail in FIG. 4, is designed to engage this aperture to prevent disengagement of the latch member from the catch housing. This lock mechanism includes a frame 78 which also serves as a rear plate for the catch housing 30 and is retained therein by a series of metal tabs 80 bent thereover. The frame has a upper and lower horizontally extending rails 82 and 84 respectively. The lower rail is formed with two cupped indentations 86. A generally C-shaped bolt member 88 has upper and lower legs 90 and 92 which are outwardly sprung from one another. The lower leg 92 has a rounded lug 94 adapted to mate with each of the indentations 86 to place the bolt member in one of two positions, namely a locked and an unlocked position shown by solid and phantom lines respectively in FIG. 4. The leading edge of the bolt member has a projecting bolt 96 adapted to pass through aperture 76 when tab 52 is received in the corresponding slot 26. Accordingly, the tab may not be disengaged from the lower catch housing.

The upper rail 90 of the bolt member 88 is formed with two depending bearing fingers 98 which are engageable by a suitable rotatable key 100 to move the bolt between its locked and unlocked positions. The key is inserted into the lower catch housing through a key hole 102 formed in the striker surface as well as through a corresponding key hole 104 formed through latch member 44.

The catch and latch assemblies of the lock of the present invention may be easily positioned for mounting on a container. In particular, the rear plate 66 of latch assembly 36 is formed with a depending tab 106 that projects through a corresponding notch 108 in lock housing 38. This tab 106 is interengagable with the alignment aperture 32 in the latch housing 30 and is guided correctly therein by a bearing finger 110 formed with the catch assembly frame plate 78. Accordingly, prior to assembly, when the hook-like tabs 52 and 54 are engaged in slots 26, the alignment tab 106 is similarly engaged in the alignment aperture 32 to hold the respective assemblies in their proper attitude. The entire assembly is then positioned with the closure and body of the container on which it is to be installed and is attached by any suitable means such as rivets or screws.

It can be appreciated that the lock of the present invention provides automatic closing as well as convenient, single motion opening of a container with minimal effort. This lock is simple, yet effective in operation and is economical to produce by mass production techniques.

Although a specific embodiment of the lock of the present invention has been described above in detail, it is to be understood that this is for purposes of illustration. Modifications may be made to the described lock structure by those skilled in the art in order to adapt it to particular applications.

What is claimed is:

1. An automatically closing lock for a container having a body and a closure mounted with the body for movement to close it, said lock comprising:

A. a catch assembly having a catch housing adapted to be mounted on one of said container closure and body, said catch housing defining
  1. a planar striker surface formed with at least one catch slot therein; and
  2. a catch surfact defined by said catch slot having a portion substantially perpendicular to said striker surface;

B. a latch assembly having;
  1. a latch housing, formed with an attachment slot, adapted to be mounted on the other of said container closure and body;
  2. a latch member pivotably mounted with said latch housing and having
    a. a web formed to overlie said striker surface,
    b. at least one tab formed with said web to interfit with said catch slot, said tab having
      1. an inclined edge formed to slidingly engage said catch housing and pivot said latch member away therefrom and to align said tab with said catch slot,
      2. a hook-like surface shaped to latchingly engage said catch surface when said tab is interfitted with said catch slot; and
    c. means for limiting pivoted movement of said latch member in said latch housing to less than 90°, said limiting means comprising:
      1. a hanger bar formed with said latch member to project into said attachment slot, and
      2. retainer means for preventing disengagement of said hanger bar from said attachment slot and against which said hanger bar binds to limit latch member pivoted movement, and C. means for urging said latch member to pivot into firm contact with said striker surface and said tab into interfitting engagement with said catch slot.

2. The automatically closing lock as claimed in claim 1 further comprising:

bolt means for selectively locking said tab in interfitting engagement with said catch slot.

3. The automatically closing lock as claimed in claim 2 wherein said catch slot passes through said striker surface, wherein said tab is formed to project through said catch slot and defines an aperture positioned on the side of said striker surface opposite said latch member web when said tab projects through said catch slot and wherein said bolt means comprises:

a bolt member mounted in said catch housing for selective movement between a locked position projecting through said tab aperture when said tab projects through said catch slot and an unlocked position withdrawn from said aperture.

4. The automatically closing lock as claimed in claim 1 wherein one of said catch housing and latch housing is formed with an alignment tab and the other is formed with an alignment aperture shaped to engage said alignment tab to properly align said housings when closed together.

5. The automatically closing lock as claimed in claim 1 wherein said retainer means comprises a retainer plate formed with at least one ledge lug and wherein said urging means comprises:

sring means engaged between said ledge lug and said hanger bar to exert a spring force that urges said latch member to pivot into firm contact with said striker surface and said tab into interfitting engagement with said catch slot.

6. The automatically closing lock as claimed in claim 1 wherein said latch member is formed with a finger release portion engagable by a finger of the user to pivot said latch member and hence said tab out of interfitting engagement with said catch slot and further to open the container closure from the body when said latch member has been pivoted by its limited amount.

7. The automatically closing lock as claimed in claim 1 wherein said tab hook-like surface is an inclined surface engagable with said catch surface to prevent disengagement of said tab from said catch slot.

* * * * *